US006715950B2

(12) United States Patent
Kim

(10) Patent No.: US 6,715,950 B2
(45) Date of Patent: Apr. 6, 2004

(54) MULTI-COLOR MARKING PEN ASSEMBLY

(76) Inventor: Allen C. Kim, 63 Orchard, Irvine, CA (US) 92620

( * ) Notice: Subject to any disclaimer, the term of this patent is extended or adjusted under 35 U.S.C. 154(b) by 0 days.

(21) Appl. No.: 10/172,073

(22) Filed: Jun. 17, 2002

(65) Prior Publication Data

US 2003/0231919 A1 Dec. 18, 2003

(51) Int. Cl.[7] ..... B43K 27/08; B43K 8/08
(52) U.S. Cl. ..... 401/35; 401/199
(58) Field of Search ..... 401/35, 198, 199, 401/196

(56) References Cited

U.S. PATENT DOCUMENTS 4,824,271 A * 4/1989 Nagahama et al. ..... 401/199 X
5,306,092 A * 4/1994 Jenq ..... 401/35 X
6,149,330 A * 11/2000 Chuang ..... 401/35 X

* cited by examiner

*Primary Examiner*—Gregory Huson
*Assistant Examiner*—Kathleen J. Prunner
(74) *Attorney, Agent, or Firm*—Erik M. Arnhem

(57) ABSTRACT

A marking pen assembly includes two or more colorant supply units and a colorant applicator detachably connected together, so that when the pen assembly is stroked along a work surface plural parallel strips of colorant are simultaneously formed on the work surface. A connecting mechanism between the colorant supply units is designed so that the units can be separated from one another and used as individual marking pens. The marking pen assembly enables the user to obtain a rainbow coloring effect with a stroke of the pen assembly.

10 Claims, 3 Drawing Sheets

MULTI-COLOR MARKING PEN ASSEMBLY

FIELD OF THE INVENTION

This invention relates to a multi-color marking pen assembly, and particularly to a marking pen assembly wherein plural marking pens can be used in combination, e.g., to simultaneously apply plural strips of colorant to a work surface.

BACKGROUND OF THE INVENTION

A marking pen is an implement that a person can grasp in his hand to apply liquid colorant to a work surface (e.g., a sheet of paper) to produce colored images. The pen usually comprises an elongated tubular barrel containing a reserve supply of liquid colorant, and a color applicator tip projecting from one end of the barrel for transferring colorant onto the work surface. The person can manipulate the marking pen to move the applicator tip back and forth on the work surface, to produce colored lines or colored patches of various length and shape. Different marking pens (having different colorants) can be used to produce multi-colored pictures or images.

In some cases it is necessary, or desirable to produce parallel colorant strips on the work surface. For Example, it may be desirable to produce an image in which a relatively light color forms the major part of the image, while a relatively dark color out-lines the image (as a border). In some instances a relatively dark colorant can be used with a relatively light colorant to produce shading or transition from one image to another.

Parallel colorant strips can be useful in colored perspective drawings. In some sign lettering the individual letters are multi-colored to provide a more eye-catching sign. A rainbow pattern is sometimes used for visual effect.

Under conventional practice it is necessary to use one marking pen for one colorant strip and a second pen for an adjacent colorant strip. When separate marking pens are used it is difficult to maintain the desired parallelism between the colorant strips. Inevitably the individual colorant strips deviate or waiver to out of parallelism. The problem becomes even more difficult when it is desired to produce three or more parallel colorant strips.

SUMMARY OF THE INVENTION

The preset invention relates to a marking pen assembly wherein plural marking pens can be used in combination to simultaneously apply plural strips of colorant to a work surface. The marking pens are detachably connected together so that the color applicator tips on all of the pens are in a common transverse plane, such that when the marking pen assembly in manipulated on a work surface the applicator tips simultaneously produce plural strips of different colorants on the work surface.

In preferred practice of the invention the marking pen assembly includes a colorant applicator that fits over the assembled marking pens to provide a continuous marking surface for applying different colorants to the work surface. When the marking pen assembly is moved over the work surface the continuous marking surface on the applicator forms a rainbow of different parallel colors.

The different colorants can be different shades of a given hue and/or entirely different hues. Any number of marking pens can be used together (within reason) to simultaneously produce parallel colorant strips, e.g., two, three or four marking pens.

The different marking pens can be detachably connected together, so that in some cases the pens can be separated for use individually. Any given marking pen can be used alone or in combination with any other similarly constructed marking pen.

DESCRIPTION OF THE PREFERRED EMBODIMENT OF THE INVENTION

Figure 1:
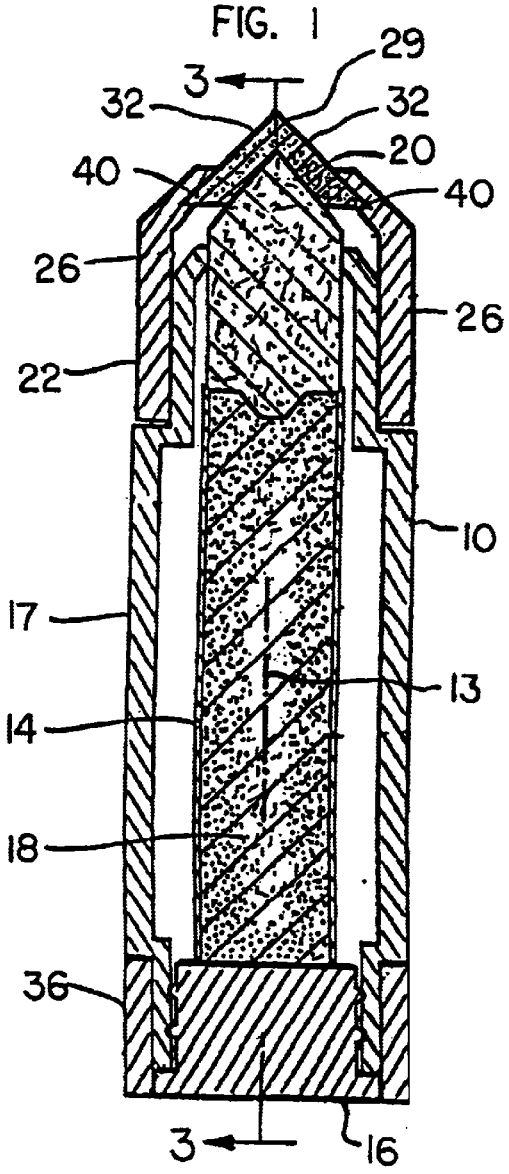
FIG. 1 is a longitudinal sectional view, taken through a multi-color marking pen assembly embodying the invention.
Figure 3:
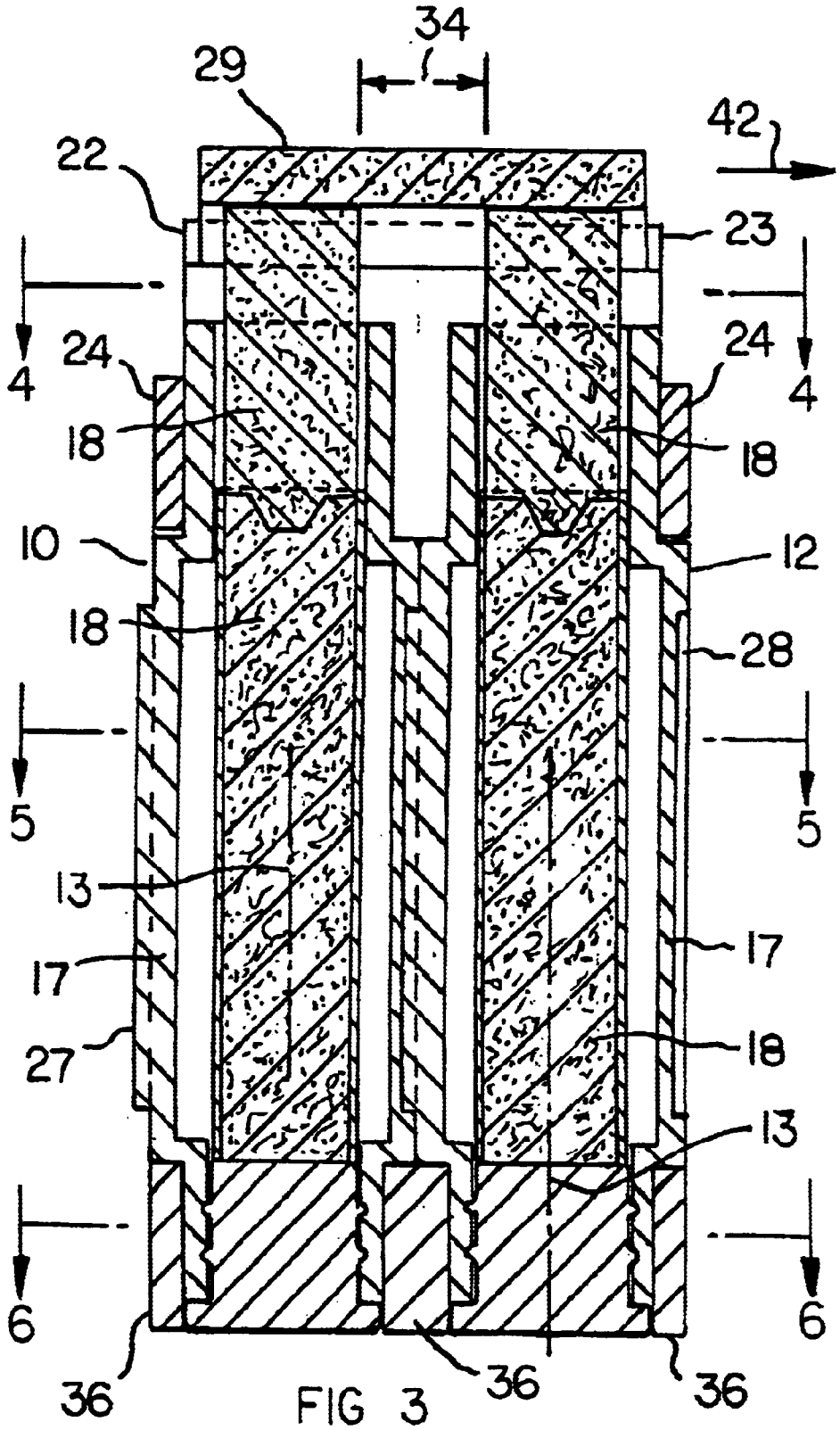
FIG. 3 is a sectional view taken on line 3—3 in FIG. 1.
Figure 4:
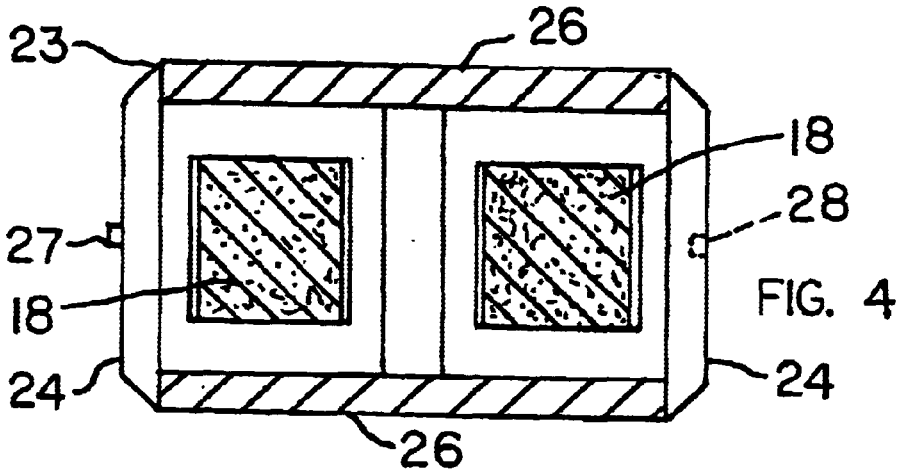
FIG. 4 is a transverse sectional view taken on lie 4—4 in FIG. 3.
Figure 5:
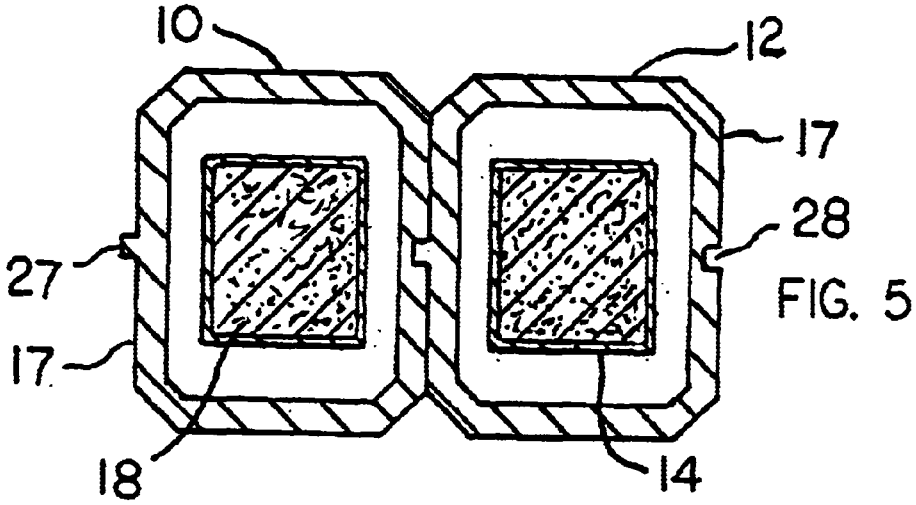
FIG. 5 is a sectional view taken on line 5—5 in FIG. 3.
Figure 6:
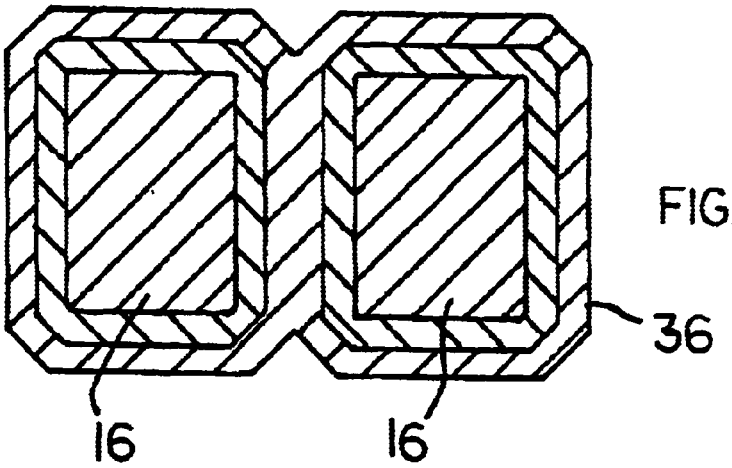
FIG. 6 is a sectional view taken on line 6—6 in FIG. 3.

Referring to FIG. 1, there is shown a multi-color marking pen assembly constructed according to the invention. The marking pen assembly includes two separate colorant supply units, each containing a different colorant. In FIG. 3 the different colorant supply units are referenced by numerals 10 and 12. Each colorant supply unit is similarly constructed except for the coloration of the ink colorant. The drawings show two colorant supply units. However, more than two supply units can be employed (depending on the number of colored strips it is desired to apply on a given work surface).

Each colorant supply unit includes an elongated tubular barrel or colorant containment tube 14 that is closed at its lower end by a closure plug 16. Each colorant containment tube has a longitudinal axis 13. As shown in the drawings, each closure plug has a snap fit connection with a housing 17 for tubular barrel 14. The barrel 14-plug assembly can be removed from housing 17 when the colorant barrel 14 is depleted. A porous fibrous wick structure 18 is packed into tubular element 14 for storing the liquid colorant. Packing 18 can be a fibrous felt pre-form saturated with liquid colorant (e.g., ink). As shown in FIGS. 1 and 3, wick structure 18 extends upwardly out of tubular element 14 to form a chisel-shaped end surface 20. Each chisel-shaped end surface is defined by two flat end faces angled to each other in a V-configuration.

The two colorant supply units 10 and 12 are oriented in parallel side-by-side relation by means of tongue and groove connection 27,28 formed integrally with the respective housing 17.

The marking assembly includes a colorant applicator 23 located on the upper ends of colorant supply units 11 and 12. Applicator 23 includes a hollow carrier 22 spanning the two color supply units so that when the carrier is fitted onto the upper ends of the assembled supply units the chisel-shaped end surfaces 20 of wick structures 18 are located within the carrier.

Figure 2:
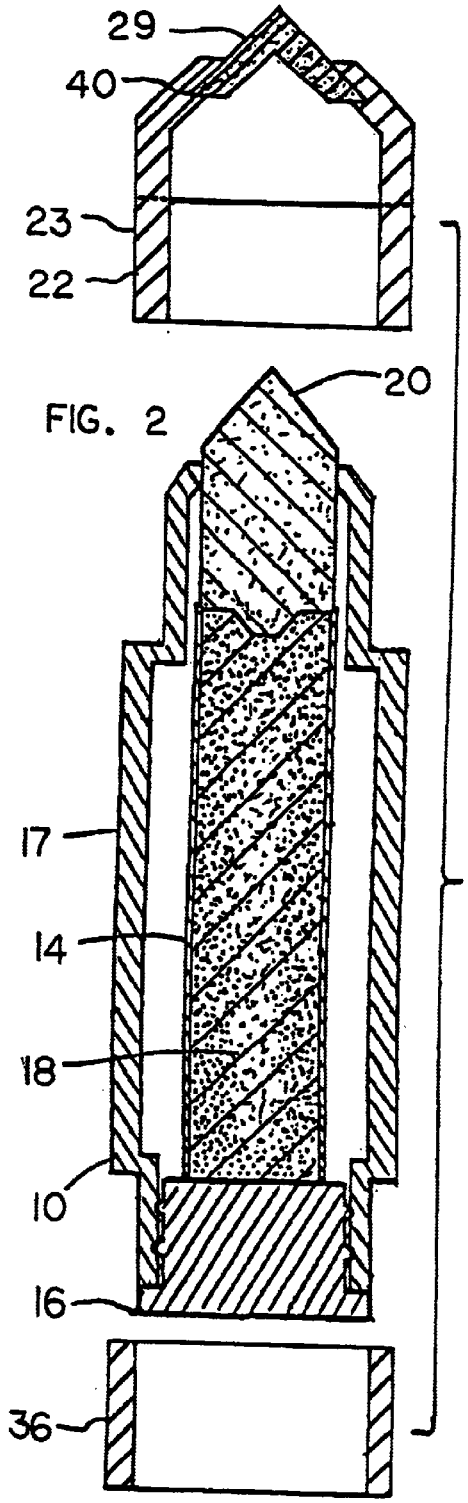
FIG. 2 is an exploded view, taken in the same direction as FIG. 1, and showing the marking pen components separated from one another.

Carrier 22 has two end walls 24 and two connecting walls 26, whereby the carrier constitutes an annular cap structure adapted to have a slidable fit on the assembled colorant supply units. FIG. 2 shows the carrier separated from the assembled colorant supply unit. FIGS. 1 and 3 show the carrier (cap structure) installed on the colorant supply unit (as a slip-fit).

A porous colorant marking element 29 is detachably mounted on carrier 22 so as to extend therealong in vertical alignment with the chisel end surfaces 20 on wick structure 18. When carrier 22 is moved downwardly onto the assembled colorant supply units parallel to the tube axes 13 the V-shaped lower interior surface of marking element 29 comes into firm pressure contact with chisel end surfaces 20, whereby liquid colorants can be simultaneously transported from wick structures 18 into porous marking element 29. As shown in FIG. 3, marking element 29 has simultaneous pressure contact with both wick structures 18, i.e., the chisel-shaped end surfaces 20.

Marking element 29 is a pre-formed porous member having capillary pores defined by compressed felt fibers, such that the marking element can be saturated with the color inks supplied by wick structures 18. As shown in FIG. 1, marking element 29 has a V-shaped cross section that provides two flat marking surfaces 32 acutely angled to each other. These flat marking surfaces provide a V-shaped marking face that can be moved in either direction along a work surface (e.g., paper surface) to apoly liquid colorant to the work surface.

FIG. 3 is taken in a common plane containing the axes of the two colorant tubes 14. FIG. 1 is taken in plane normal to the plane of FIG. 3. FIG. 1 illustrates the V-shaped nature of marking element 29.

When marking assembly is moved along a work surface in a direction paralleling the plane of FIG. 1 the colorants will be applied as parallel strips onto the work surface. As shown in FIG. 3, wick structures 18 are spaced apart by a separation distance 34. However, some colorants will diverge into marking element 29 as colorants move toward marking surfaces 32. Therefore, the colorant strip spacing on the work surface will be substantially less than the separation distance 34. Also the color density of each colored strip will decrease somewhat in the strip separation zone. The colorant strip spacing on the work surface can be varied by varying the separation distance 34 (i.e., by changing the width dimension of each housing 17).

The marking assembly shown in the drawings can be used to simultaneously apply parallel strips of different colorants to a work surface, thereby achieving a rainbow effect or multi-color shading. Since the different colorants are applied simultaneously the color parallelism remains uniform along the length of the marking assembly stroke.

As an optional feature, the colorant supply units 10 and 12 can be firmly secured in the connected condition by means of an auxiliary ring structure 36. The ring structure is is sized to encircle the assembled colorant supply units as a slip fit. FIG. 2 shows the ring structure separated from the assembled colorant supply units. FIG. 1 shows the ring structure installed on the colorant supply units, whereby the units are firmly connected together for handling and manipulation purposes.

Marking element 29 is preferably detachably mounted on carrier 22, so that the marking element can be readily cleaned or replaced when necessary. The upper ends of walls 26 can be grooved, as at 40, to form guideways for slidably supporting edge areas of marking element 29. The marking element can be removed from carrier 22 by sliding the element in the arrow 42 direction (FIG. 3).

FIG. 3 is taken in a plane containing the axes of the two colorant tubes 14. The movement path 42 is located in the FIG. 3 plane, which is normal to the path taken by the marking assembly during normal marking movement. Therefore, there is minimum chance for marking element 29 to be inadvertently displaced from it operating position.

The drawings show a marking assembly that includes two colorant supply units 10 and 12. The associated colorant applicator 23 and ring structure 36 are sized to fit the two colorant supply unit assembly. When more than two colorant supply units are used, the applicator 23 and ring structure 36 have to be sized and structured accordingly.

When the applicator and ring structure are disconnected from the colorant supply units, as shown in FIG. 2, each colorant supply unit can be used individually as a colorant marking pen.

The drawings necessarily show a specific form of the invention. However, it will be appreciated that the invention can take various forms and configurations. The components may be formed out of plastic materials.

What is claimed:

1. A multi-color marking assembly comprising:

plural parallel colorant supply units connected together in side-by-side relation; each colorant supply unit comprising an elongated colorant containment tube having an axis and a porous wick structure packed into said tube, said wick structure projecting from said tube along said axis for transporting liquid colorant out of said tube; said wick structures having flat end surfaces located outside the associated containment tubes;

a colorant applicator that includes a carrier (22) spanning said colorant supply units so that an end surface on each said wick structure is located within the carrier, and a porous capillary colorant marking element extending along said carrier, in facial contact with said wick structures, for simultaneously applying parallel strips of different colorants to a work surface when the marking assembly is moved over a work surface;

said marking element having flat interior surface thereof in firm facial contact with the flat end surfaces on said wick structures, whereby colorants are transferred from said wick structures into said porous marking element.

2. The marking assembly of claim 1, wherein said porous marking element has a V-shaped cross section in a plane taken normal to a common plane containing the axes of the colorant tubes.

3. The marking assembly of claim 1, wherein said porous marking element has two flat marking surfaces acutely angled to form a V-shaped marking face in a plane taken normal to a common plane containing the axes of the colorant tubes.

4. The marking assembly of claim 1, wherein said porous marking element is detachably mounted on said carrier, whereby said marking element can be cleaned and replaced.

5. The marking assembly of claim 1, wherein said porous marking element is slidably mounted on said carrier for movement along a path that is located in a plane taken normal to a common plane containing the axes of the colorant containment tubes, whereby said marking element can be cleaned and replaced.

6. The marking assembly of claim 1, wherein said carrier comprises an annular cap structure slidable onto said plural parallel colorant supply units, in a direction that parallels the axes of the colorant containment tubes.

7. The marking assembly of claim 6, and further comprising a ring structure (36) sized to encircle said plural parallel colorant supply units in a plane remote from said cap structure, whereby said colorant supply units are firmly connected together for ready manual manipulation by a user of the marking assembly.

8. The marking assembly of claim 1, wherein said carrier comprises an annular cap structure (22) that has a slidable fit onto said plural parallel colorant supply units in a direction parallel to the axes of the color containment tubes, so that said porous marking element has simultaneous pressure contact with said wick structures.

9. The marking assembly of claim 8, wherein each said wick structure has a chisel-shaped end surface in firm facial contact with said porous marking element.

10. The marking assembly of claim 1, wherein each colorant supply unit further housing (17) and a closure plug (16) for the associated colorant tube (14); each said closure plug having a snap fit connection with the associated housing (17) whereby each colorant supply unit is a self-contained device that can be used individually as a colorant marking pen.

* * * * *